United States Patent [19]

Galbraith et al.

[11] 4,270,859

[45] Jun. 2, 1981

[54] ELECTROPHOTOGRAPHIC APPARATUS FOR PROVIDING DRY DEVELOPED OUTPUT FROM A TYPESETTER

[75] Inventors: Wiley E. Galbraith, East Northport, N.Y.; Arthur L. Kaufman, Westport, Conn.; Herbert Klepper, Mineola, N.Y.

[73] Assignee: Eltra Corporation, Toledo, Ohio

[21] Appl. No.: 37,698

[22] Filed: May 10, 1979

[51] Int. Cl.[3] ..... G03G 15/10

[52] U.S. Cl. ..... 355/10; 355/16

[58] Field of Search ..... 355/10, 13, 16, 3 R, 355/3 CH; 354/5; 101/DIG. 13

[56] References Cited

U.S. PATENT DOCUMENTS

| | | | |
|---|---|---|---|
| 3,572,288 | 3/1971 | Turner | 118/657 |
| 3,650,622 | 3/1972 | Morse | 355/16 X |
| 3,851,964 | 12/1974 | Smith | 355/10 |
| 3,893,417 | 7/1975 | York | 355/10 X |
| 3,930,251 | 12/1975 | Salava et al. | 354/5 X |
| 4,014,031 | 3/1977 | Hasegawa et al. | 354/5 |
| 4,044,718 | 8/1977 | Blake et al. | 355/10 X |
| 4,122,462 | 10/1978 | Hirayama et al. | 354/5 |
| 4,141,648 | 2/1979 | Gaitten et al. | 355/3 CH |

*Primary Examiner*—R. L. Moses

*Attorney, Agent, or Firm*—Joel I. Rosenblatt

[57] ABSTRACT

The present invention is concerned with an electrophotographic apparatus for producing high quality, toned, first generation images. The apparatus includes:

(a) a transporting device, such as a drum, belt or platen for supporting and transporting an image receiving medium, such as ZnO-coated paper, having a flexible substrate and a photoconductive surface;

(b) a charging device, such as a scorotron, disposed adjacent to the transporting device, for applying a uniform charge on the photoconductive surface of the image receiving medium, this charge being substantially less than the saturation charge of the surface;

(c) an exposing device, such as an illuminated character mask or a laser scanner, for directing radiation onto the photoconductive surface after charging at the areas where toned images are to appear, thereby to discharge the surface at these areas; and (c) a developing device disposed adjacent to the transporting device, for applying liquid toner to the discharged areas on the photoconductive surface after exposing. The toner particles are triboelectrically charged with the same sign as the photoconductive surface and are thereby repelled from the photoconductive surface except at the areas thereof which have been discharged by exposure to radiation.

62 Claims, 22 Drawing Figures

LOADING
AND CHARGING

EXPOSING

DEVELOPING
AND STRIPPING

ELECTROPHOTOGRAPHIC APPARATUS FOR PROVIDING DRY DEVELOPED OUTPUT FROM A TYPESETTER

The present invention relates to electrophotographic apparatus for producing high quality, toned, first-generation images on a suitable flexible record or image receiving medium such as paper.

Electrophotography may be defined as the art or method of forming and utilizing an electrostatic image on an insulating and normally photoconductive surface to produce a visible or toned image. The basic process steps of electrophotography are charging, whereby a layer of electrostatic charge is formed or deposited on a photoconductor; exposing, whereby a charged photoconductor is exposed to a radiant pattern thereby forming an electrostatic latent image; developing, whereby an electrostatic image is treated to become visible; and fixing whereby a developed image is permanently fixed on the final image receiving medium. In certain electrophotographic apparatus the images are developed on a separate photoconductor and then transferred to an image receiving medium such as ordinary paper. In other apparatus the images are formed and developed directly on the image receiving medium, which may be paper that is specially treated with a photoconductive material. In the former type of apparatus the photoconductor is repeatedly used in forming electrostatic latent images, whereas in the latter apparatus the photoconductor is used only once to form and develop an electrostatic latent image.

Electrophotography has found widespread, general use in the production of "copies" of original documents and in producing high speed output from data processors or computers. Such "hard copy" has been fully satisfactory for the purpose intended, namely as readable documents for routine business use. However, the quality of reproduction is an order of magnitude below what is termed "graphic arts quality": that is, the image quality normally associated with original, printed documents as are generated by a typesetter for example.

There are a number od determinative measures which may be used to distinguish graphic arts quality over copier quality reproduction.

(1) Resolution: Resolution is a measure of the distinguishability of individual, closely adjacent parts of an image. Graphic arts quality images have a minimum resolution of 20 line pairs per millimeter as seen through a microscope. In contrast, line copy images reproduced by an electrophotographic "copier" have a nominal resolution at best of 10 line pairs per millimeter.

(2) Background Level: The background area in graphic arts quality documents should be relatively free of unwanted specks or "noise" and should have a low degree of gray tone. Background tone is quantified by the so-called "reflection density" which is a ratio of the light impinging upon, to the light reflected from an opaque surface as measured by a reflection densitometer. For graphic quality reproduction the reflection density should be no greater than 0.1.

(3) Solid Density Uniformity: The solid density uniformity is determined by the range of reflection densities for solid (e.g., black printed) areas. The reflection density for such areas should be greater than one (meaning that 1/10 of the impinging light is reflected) with a variation of no more than about 10% of density value. For example a range of reflection densities of 1.2–1.4 is considered acceptable for photographic output from a typesetter.

(4) Edge Gradient: The edge gradient is the rate of change or slope of the reflection density at the edge of a solid image. For example, with a black character, the reflection density may drop at the edge from 1.4 (the solid reflection density) to 0.1 (the background reflection density). The distance along the image receiving medium in which the reflection density falls from 1.4 to 0.1 determines the edge gradient. Obviously, the edge gradient is related to, but is not the same as resolution. Graphic arts quality images should have a high edge gradient because typography or character design requires clean, sharp edges for aesthetic appeal.

Notwithstanding the fact that, so far as is known, electrophotography has not succeeded in producing images meeting all of the above graphic arts quality requirements, electrophotographic technology would find advantageous use in a typesetter. Typesetters conventionally use a photographic or silver halide process to produce developed images on paper or film. This process requires at least two materials—namely, a developer and fixer—in addition to the paper and possibly also a washing fluid. The photographic papers and films are relatively expensive and the developer and fixer are corrosive. In addition, the photographic paper has a relatively short shelf life and is unusable if it is accidentally exposed to light.

Electrophotographic apparatus, at least theoretically, has the potential for eliminating these various drawbacks of the photographic process. Both the materials and the machine required for electrophotography may be less expensive and easier to use than the corresponding apparatus and materials required for a silver processor.

Because of its unique characteristics, however, electrophotography cannot be readily adapted to provide a dry output from a typesetter. The first problem is the quality of the output, referred to above. Normal, copier quality is far below the standards used in the graphic arts industry.

A second problem concerns the dark decay rate of a photoconductor. In typesetter applications where exposure of the photoconductor is carried out letter by letter or computed raster line by raster line, the time between changing and toning may be as long as ten to twenty minutes as compared to, say, ten seconds or less for a typical office copier. Therefore, if electrophotography is to be used to produce dry developed output from a typesetter, the photoconductor must exhibit an extremely low dark decay rate.

In a typical typesetter, an image is exposed in the opposite sense from the usual copier situation. With a copier, light strikes the photoconductor, thus discharging the photoconductor, in areas where no image is to appear. With the typesetter, the light or radiation strikes the photoconductor, dissipating the charge, at the places where a toned image is to appear. Therefore, toning in such apparatus must be done by electrostatic repulsion, rather than the usual charge attraction. This type of toning is known in the art as "reversal development".

Since in reversal development the toner is deposited on any area which carries less charge than an adjacent area, the photoconductor must accept and maintain an extremely uniform initial charge. Any non-uniformity of applied charge or any defect in the photoconductor that does not accept initially or loses it more rapidly than an adjacent area will result in unacceptable toner specks in the background.

In summary, for typesetter applications both the toned (image) and untoned (background) areas must meet exceptional requirements. Since typeset characters may be large and relatively heavy, the toned areas must have uniform and dense large-area solid fill. The background areas must have an acceptably high photopic brightness ($\overline{Y}$) with little or no "noise".

Finally, it is desirable that electrophotographic apparatus for providing dry developed output from a typesetter be convenient to use. It should present a prompt output which has been dried rapidly and efficiently; that is, with a relatively modest requirement for energy.

SUMMARY OF THE INVENTION

A principal object of the present invention is to provide electrophotographic apparatus for producing high quality, toned, first generation images.

A further object of the present invention is to provide electrophotographic apparatus for use with a typesetter which meets the various requirements set forth above.

These objects, as well as further objects which will become apparent in the discussion that follows, are achieved, according to the present invention, by providing a particular configuration of elements, to be described below, for charging, exposing and developing images on a flexible substrate, such as paper, coated with a layer of photoconductive material, such as zinc oxide. In particular, the apparatus shall comprise:

(a) a transporting device, such as a drum, belt or platen for supporting and transporting an image receiving medium, such as ZnO-coated paper, having a flexible substrate and a photoconductive surface;

(b) a charging device, such as a scoroton, disposed adjacent to the transporting device, for applying a uniform charge on the photoconductive surface of the image receiving medium, this charge being substantially less than the saturation charge of the surface;

(c) an exposing device, such as an illuminated character mask or a laser scanner, for directing radiation onto the photoconductive surface after charging at the areas where toned images are to appear, thereby to discharge the surface at these areas; and (d) a developing device disposed adjacent to the transporting device, for applying liquid toner to the discharged areas on the photoconductive surface after exposing. This developing device includes a reservoir of liquid toner comprising toner particles suspended in a liquid dispersant and some means for moving the liquid toner in the reservoir into contact with the photoconductive surface at the appropriate time. The toner particles are triboelectrically charged with the same sign as the photoconductive surface and are thereby repelled from the photoconductive surface except at the areas thereof which have been discharged by exposure to radiation.

In the preferred embodiment of the invention, the image receiving medium is supplied in the form of a web roll rather than in sheets to simplify the feeding mechanism. The electrophotographic apparatus of this embodiment therefore comprises a spindle for rotatably holding the web roll and pinch rollers or the like for delivering the web from the roll to the transporting device. A controllable cutter may be arranged between the web roll and the transporting device for cutting the web into sheets before they are supplied to the transporting device. Alternatively, the cutter may be arranged to follow the transporting device so that the image receiving medium is electrophotographically processed in web form to any desired length.

It is important that the image receiving medium supported by the transporting device be maintained at a precise location with respect to the charging, exposing and developing stations. In particular, in order to lay down a substantially uniform charge on the photoconductive surface of the image receiving medium, this surface must be held at a constant distance from the charging device.

According to an advantageous feature of the invention, the transporting device includes a movable carrier surface for removably holding the image receiving medium and a vacuum source for applying a vacuum to the carrier surface to draw the image receiving medium into intimate physical contact therewith. In the preferred embodiment the transporting device is a rotatable drum, the external surface of which forms the aforesaid carrier surface. The drum has an interior chamber and a plurality of openings extending outwardly from this chamber to its exterior surface. The source of vacuum is operative to evacuate the interior chamber of the drum.

In operation, the web of the image receiving medium is removed from the web roll and its leading edge is brought into contact with the transporting drum as the drum rotates. Wherever the image receiving medium covers a hole on the surface of the drum it is drawn into intimate physical contact with the drum by the differences in pressure above and below. When sufficient length of web has been passed to the drum the web is cut off by the cutter so that the drum holds a single sheet. This sheet is then processed to produce a toned image by moving it past successive electrophotographic stations located around the drum. Because the sheet is held tightly against the drum or carrier surface, the photoconductive surface on the sheet can be accurately positioned with respect to each station.

The uniformity of charge deposited on the photoconductive surface is further enhanced, in the preferred embodiment of the present invention, by the use of a screen controlled corona charging device, or "scorotron", which employs a control grid in addition to a corona wire. By use of a scorotron as a charging device, the non-uniform emission of electrons (e.g., "hot spots") along the length of the corona wire wall will be equalized by voltage controlled grid wires so that the charge deposited on the photoconductive surface will be substantially uniform across the width of the sheet. In order to eliminate possible voltage breakdowns at various points on the photoconductive surface due to non-uniformities in the coating layer, the charge is maintained at a level substantially below the saturation charge of the surface, preferably in the range of 250–300 apparent surface volts (asv).

The exposing system used in the apparatus according to the present invention depends upon the nature of the particular typesetter with which it is associated. The present apparatus is not limited in its application and can be used with either the so-called "second generation" or "third generation" of typesetters.

The field of automated typesetting has experienced ever-accelerating advances since Ottmar Mergenthaler developed the Linotype® machine for semiautomatically producing lines of type metal. The Linotype machine and its progeny of "hot metal" typesetters have been called the "first generation" of automatic typesetters. These typesetters were refined over the years and are still in use in some locations.

The second generation of typesetters, which were pioneered by René Higonnet and Louis Moyroud among others, are called photo-mechanical typesetters, or simply "phototypesetters". In these machines, one or more fonts of characters are arranged on a character carrier or photographic "font strip" providing a negative image of each character. This font strip is arranged on a drum for continuous rotation to repeatedly bring the characters into alignment with an optical system which includes a xenon flashlamp. When a character is to be imaged, the flashlamp is fired at the precise time that the desired character is in alignment with the optical system so that light passes through that character and is focused to provide a light image thereof on the image receiving medium.

Phototypesetters are currently enjoying a period of maximum use in the graphic arts industry, but are being improved upon by third generation machines: the so-called "CRT" or "laser" typesetters.

In third generation (CRT or laser) typesetters characters are electronically generated by repeatedly and rapidly scanning a beam of light across the image receiving medium. During scanning, the light beam is electronically switched on and off, thereby forming a raster line which extends either vertically (perpendicular to the lines of type) or horizontally (parallel to the lines of type). The device for generating the light beam may comprise either a cathode ray tube (CRT) or a laser. In the former case, the CRT preferably has a plurality of optical fibers arranged on its fluorescent faceplate to transmit light from the faceplate to the image receiving medium. In the latter case, the laser beam is preferably switched on and off by an acousto-optic modulator and reflected from a tilting mirror which creates the beam scanning motion.

According to another advantageous feature of the invention, the electrophotographic apparatus includes a device for "prewetting" the photoconductive surface of the image receiving medium after charging and exposing, but before developing the latent image on the surface. This prewetting device deposits a liquid dispersant onto the photoconductive surface, forming a wet layer, before this surface comes in contact with the liquid toner. This wet layer inhibits toner particles in the liquid toner from prematurely contacting the photoconductive surface during the developing process which would produce a uniform background level and/or specks on the final, dry output. Since the liquid dispersant used as a prewetting agent will come in contact and eventually mix with the liquid dispersant used in the liquid toner, these two liquid dispersants are preferably identical. A suitable liquid dispersant such as odorless mineral spirits is usable both as a prewetting agent and in the liquid toner.

As explained in the "Background of the invention" section above, one of the requirements of electrophotographic apparatus used in a typesetter is an extremely low rate of dark decay. This requirement results from the relatively long exposure period in a typical typesetter; that is, the time it takes to image an entire sheet or page. It has been found that the vapors of the liquid dispersants in both the prewetting device and the developing device tend to discharge the photoconductive surface, thus effectively increasing the dark decay rate. According to a particular feature of the present invention, means are provided which inhibit the vapors of the liquid dispersants from reaching the photoconductive surface. These means may take the form of an air circulation device or a device for moving the prewetting device and/or the developing device away from the photoconductive surface when not in use or a device for inserting a vapor shield between the prewetting device and/or the developing device on one hand, and the photoconductive surface on the other.

According to another preferred feature of the present invention, the developing device includes a toner shoe, disposed adjacent to the transporting device, which functions as a counter electrode for electrostatically driving the toner particles in the liquid toner towards the photoconductive surface. This counter electrode is preferably grounded or maintained at a charge, for example in the range of 50–150 volts. If the photoconductive surface is negatively charged, a negative charge is maintained on the counter electrode.

Conveniently, the developing device is disposed below the transporting device (e.g., drum) with the liquid toner reservoir arranged beneath the counter electrode. A pump may be provided for lifting the liquid toner, on demand, from the reservoir to the photoconductive surface.

According to another advantageous feature of the present invention, means are provided for removing excess liquid toner from the photoconductive surface as the surface emerges from the developing device without physical contact therewith. While toner particles will actually be attracted to the photoconductive surface only at the discharged areas thereof, the liquid toner will "wet" the entire developed area on the photoconductive surface and must be eliminated before the surface is dried. Otherwise, toner particles will remain and adhere to background areas during the drying process.

One prior art technique for removing excess toner has been to provide a wiper or "squeegee" at the outlet of the developing device to physically rub off the excess toner. Such an arrangement is only adequate for copier quality images because it tends to smear the toner in the discharged areas. In the preferred embodiment of the present invention, an "air knife" is provided for directing a stream of air against the photoconductive surface, preferably in a direction perpendicular thereto, to move the excess liquid toner carried forward on the surface back into the developing device.

At the outlet end of the electrophotographic apparatus according to the invention a device, such as a movable finger, is provided to remove the image receiving medium from the transporting device after this medium passes the developing device. The movable finger is preferably arranged to be placed in the path of the leading edge of the image receiving medium, thereby to intercept the leading edge after it passes the developing device. Finally, means are provided for drying the image receiving medium after it is removed from the transporting device. This drying means preferably includes a device for directing a stream of air, either heated or unheated, against the photoconductive surface of the image receiving medium. In the preferred embodiment the stream of air additionally inhibits contact of the photoconductive surface with structural parts of the machine, avoiding smearing of the image.

DESCRIPTION OF THE PREFERRED EMBODIMENTS

Figure 1:
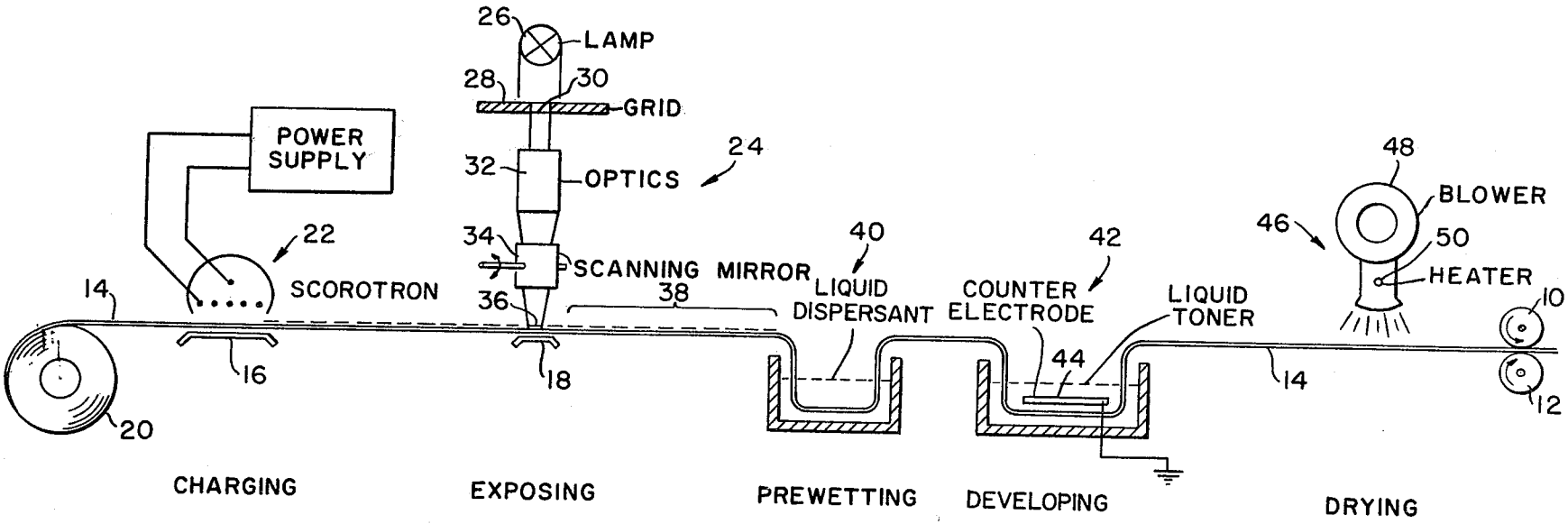
FIG. 1 is a schematic illustration of the process steps executed by the electrophotographic apparatus according to the present invention.

The preferred embodiments of the present invention will now be described with reference to FIGS. 1–10 of the drawings. Common elements in the various figures are designated with the same reference numerals.

FIG. 1 shows the basic process employed by the apparatus according to the present invention. The apparatus includes a "transporting device" for transporting an image receiving medium, such as ZnO coated paper, having a flexible substrate and a photoconductive surface. In FIG. 1, the transporting device consists of pinch rollers 10 and 12 for drawing a web 14 of the image receiving medium through the machine and suitable platens 16 and 18 for holding the web in proper position in the respective electrophotographic stations. It will be understood that the "transporting device" may also include various other suitable devices of the type known in the art for handling the image receiving medium. The web 14 is unwound from a roll 20 and passed to a charging station comprising a scorotron 22. The scorotron applies a substantially uniform charge to the photoconductive surface of the image receiving medium. This is accomplished by charging the photoconductive surface to a level which is substantially less than (for example, one-half of) the saturation charge of the surface. The reason for this charging technique will be described below in connection with FIG. 4.

The image receiving medium is then passed to the exposing station 24 which is schematically illustrated in FIG. 1 as an imaging system of the type used in phototypesetters. This system consists of a xenon flashlamp 26, a photographic "font strip" 28 providing a negative image 30 of a character, and an optical system 32 which, together with a scanning mirror 34, focuses an image 36 on the photoconductive surface of the web 14. A phototypesetter imaging system suitable for use with the present invention is disclosed in the U.S. Pat. Nos. 3,881,801 and 4,027,313.

As is well known in the electrophotographic art, the charge deposited on the photoconductive surface, in this case a negative charge, is discharged at the areas in which the surface is exposed to radiation. Thus, the presence and absence of a charge on the surface after exposure, as shown in the region 38, represents an electrostatic "latent image" of the exposed characters.

The web 14 is moved next through a prewetting stage 40 in which a liquid dispersant is deposited on the photoconductive surface. The preferred liquid dispersant employed in the process according to the present invention is odorless mineral spirits such as Soltrol 100, available from Philips Chemical Corp. or Isopar G available from Exxon Corp.

Thereafter, the web 14 is passed to a developing stage 42 which comprises a bath of liquid toner and a counter-electrode 44. The liquid toner is formed by mixing a liquid toner "concentrate" with a liquid dispersant, preferably the same dispersant used as the prewetting agent. A suitable toner concentrate is available from Philip A. Hunt Corp. and may be mixed with the dispersant in a ratio of 24 millimeters of concentrate to each liter dispersant. As more and more of the web 15 is developed it is desirable to replenish the liquid toner by adding small amounts of toner concentrate.

The counter electrode 44 functions to electrostatically drive the toner particles in the liquid toner toward the photoconductive surface. This counter electrode may be grounded, as shown, or maintained at a controlled voltage; e.g., in the range of 50–150 volts (negative). It will be understood that the potential maintained on the counter electrode will determine the "developing speed" in a photographic sense.

After developing of the latent image, the web 14 is moved to a drying stage 46 which includes a device, such as a blower 48, for directing a stream of air against the photoconductive surface. A resistive wire 50 or the like is preferably provided to heat the stream of air produced by the blower.

Figure 2:
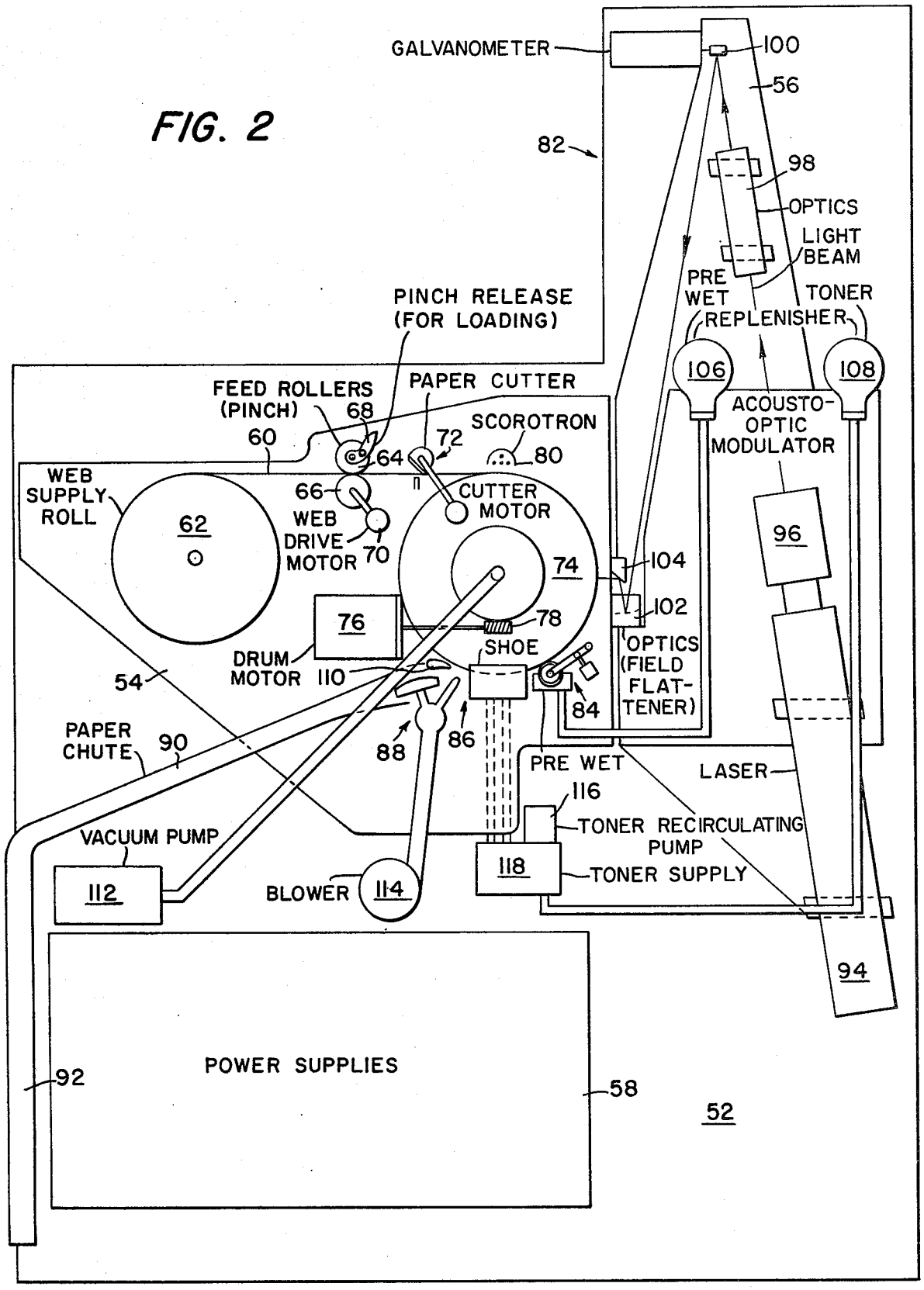
FIG. 2 is a schematic diagram of a preferred embodiment of the electrophotographic apparatus according to the present invention.

FIG. 2 illustrates a preferred embodiment of electrophotographic apparatus, according to the present invention, for carrying out the process shown in FIG. 1. This apparatus comprises a frame 52 on which are mounted first and second support frames 54 and 56 as well as power supplies 58. The image receiving medium 60 is supplied from a replacable web roll 62 and passed through a pair of feed rollers 64 and 66. The upper feed roller 64 is normally spring biased downward against the lower feed roller 66, but may be released by pressing a lever 68. The lower feed roller 66 is rotated by a drive motor 70 to move the web 60 forward at the speed of one inch per second.

The web 60 is passed to a cutter 72 which cuts the web into sheets, 19 inches in length. These sheets are wrapped around a rotatable drum 74, 21 inches in circumference, and held in place by vacuum applied through apertures in the outer surface of the drum. The drum is driven at the desired speed by a motor 76 acting through a worm gear 78. Surrounding the drum in a clockwise direction are the scorotron 80, an exposing system 82, a prewetting device 84, a developing device 86 and a drying device 88. After drying, the paper sheet is passed through a chute 90 and deposited in a "basket" 92.

The exposing system 82 shown in this embodiment repeatedly and rapidly scans a beam of light across the width of the paper sheet 60; i.e., horizontally to the lines of type. The light beam is generated by a laser 94 and is switched on and off in response to an electronic control signal by an acousto-optic modulator 96. The beam is passed through focusing lenses 98 and reflected downward from a scanning mirror 100. Thereafter, the beam is reflected from a spherical mirror 102 which serves as a field flattener. The purpose and construction of the field flattener mirror 102 are described in the aforementioned U.S. Pat. No. 3,881,801. Finally, the beam is reflected into the horizontal plane by a stationary plane mirror 104.

The prewetting device 84, developing device 86 and the drying device 88 will be described in greater detail hereinafter. As may be seen, however, the prewetting device is replenished with liquid dispersants from a bottle 106, and the developing device is replenished with toner concentrates from a bottle 108. Fingers 110 are provided adjacent the drying device 88 to remove the leading edge of the paper sheet from the drum 74.

Near the lower part of the frame 52 are arranged a vacuum pump 112 connected to draw air from the interior of the drum 74, a blower 114 connected to supply air to the drying device 88 and a toner recirculating pump 116 and a reservoir 118 operative to pass liquid toner to, and receive liquid toner from the developing device 86.

Figure 3A:
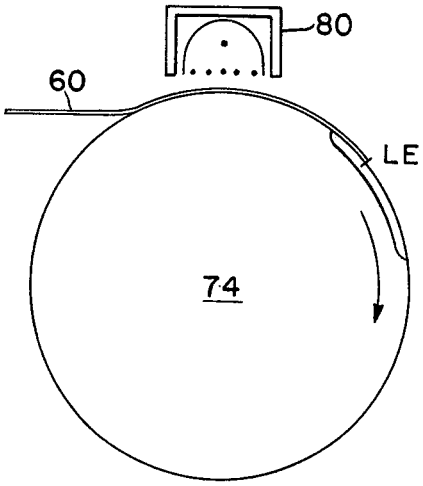
FIGS. 3A–3F are diagrams showing progressive positions of the image receiving sheet during operation of the apparatus of FIG. 2.
Figure 3B:
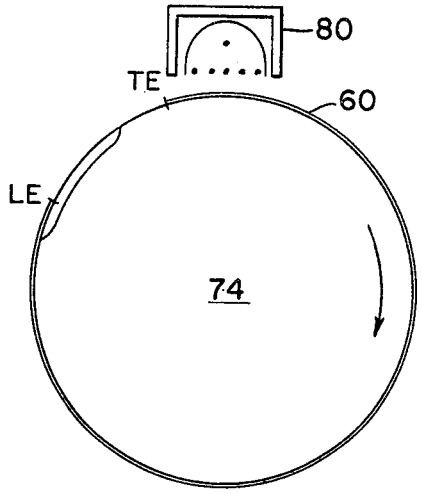

FIGS. 3A–3F illustrate the operation of the apparatus shown in FIG. 2. Initially, during loading and charging, the drum 74 is rotated at a surface speed of one inch per second. As shown in FIGS. 3A and 3B, the leading edge "LE" of the paper sheet 60 is rotated one complete revolution until the trailing edge ("TE") has passed the charging device 80.

Figure 3C:
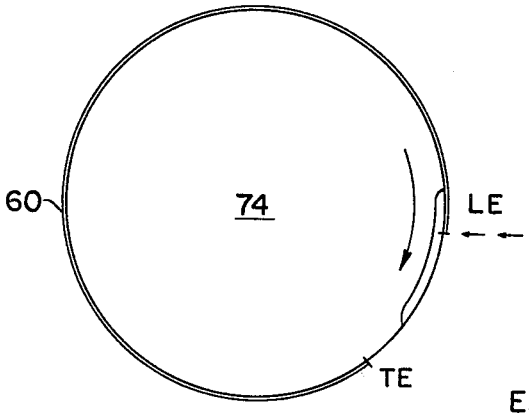
Figure 3D:
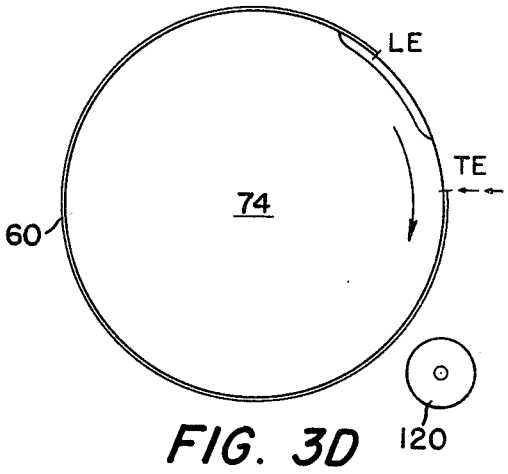

After the entire sheet has been charged and the leading edge has been brought forward to the exposing position shown in FIG. 3C, the surface drum speed is reduced to approximately 0.05 inches per second. In fact, the surface of the drum is incremented forward after each raster scan by the width of one scan line. After the sheet has reached the position shown in FIG. 3D, the exposing cycle is complete and the surface speed of the drum is increased to ½ inches per second.

Figure 3E:
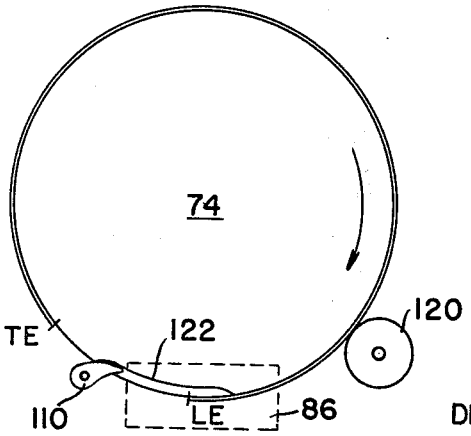

After the trailing edge of the sheet 60 has passed the prewetting roller 120, the roller is moved toward the drum as indicated in FIG. 3E. The roller 120 therefore deposits a liquid dispersant on the sheet 60, commencing with the leading edge. Just before the leading edge is introduced into the developing device 86, the liquid toner is pumped upward and brought into contact with the sheet 60. As the leading edge of the sheet emerges from the developing device 86, the fingers 110 are rotated counterclockwise into recesses 122 in the drum 74 to catch the leading edge and strip it away from the drum. Thereafter, the sheet 60 is moved past the drying device, through the chute to the output basket.

Figure 4:
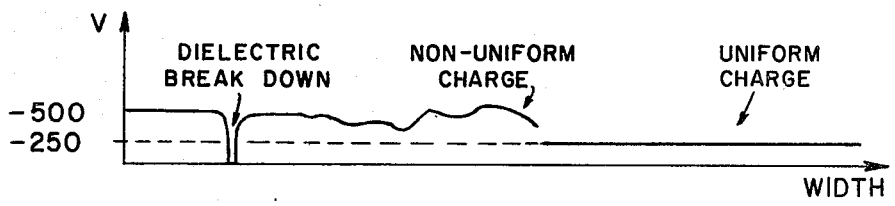
FIG. 4 is a diagram showing a typical charge pattern on a photoconductive surface.

FIG. 4 illustrates the nature of the charging employed in the apparatus in FIG. 2. Due to the charge repulsion development any non-uniformity in charge across the width of the sheet 60 will result in the deposition of toner on the photoconductive surface. To eliminate this possible background toning, the charge deposited on the surface must be substantially uniform. FIG. 4 illustrates how the charge may be uniformly deposited on the surface by charging to a voltage substantially less than the saturation charge of the photoconductive surface. If a saturation charge is applied, as indicated on the left-hand side of FIG. 4, irregularities in the photoconductive layer may result in dielectric breakdown and variations in the quantity of electrons emitted by the corona wire of the corona charging device may produce non-uniformities in charge.

On the other hand, if the charge applied to the photoconductive surface is kept substantially below the saturation charge of the surface; if a screen controlled corona charging device or "scorotron" is employed and if the distance between the photoconductive surface and the scorotron is small (say within ⅛ inch) and uniform across the width of the sheet, the charge applied to the photoconductive surface will be substantially uniform as indicated at the right-hand side of FIG. 4.

A photoconductive substrate serving as an imaging medium may comprise a conductive base and a photoconductive coating such as ZnO in a binder. A barrier coat may be placed between the base and the coating. While a uniform coating is a goal, in preparing the photoconductive coating, bubbles may appear in the coating or the base may have an irregular surface or contain holes producing a nonuniform density and/or coating surface depth. In repulsion toning, where the photoconductive surface is charged to less than a full saturation charge, then the probability is less, that the dielectric photoconductive coating in these nonuniform areas will breakdown under the electric charge. Where the charge is high enough to break down the dielectric, then the dielectric will be incapable of holding the charge and will contain less than full charge and in many cases zero charge or a charge level comparable to the level of the discharged areas. In repulsion toning, when the toner is driven to the discharged image areas, it will also be driven to those spots in the background area which were broken down by the charge, due to the high level of charge and/or the nonuniformity of the dielectric of the imaging surface.

In repulsion type toning, a charge less than saturation charge becomes extremely important to the graphic arts quality image. As it is difficult to obtain an imaging surface having uniform dielectric properties, it is important to charge to a level substantially less than saturation charge in order to decrease the probability of dielectric breakdown and zero charge level in the background areas. Where dielectric breakdown does occur, the broken down areas have little or no charge, then their charge is approximately that of the discharged or image areas, and they receive and hold toner driven towards the images areas, producing speckles in the background areas.

Typical voltages which may be applied to a scorotron to produce the desired uniform charge of approximately −250 asv are:

corona wire—8,000–9,000 volts;

grid wires—400–600 volts.

In repulsion type toning, the toner has the same charge as the charge placed on the sheet 60. For example, if the photoconductive surface is negatively charged, then the toner particles would also be negatively charged and a negative charge is maintained on the counter or development electrode 44 shown in FIG. 2. As the imaged areas are discharged, the voltage on the development electrode 44, being the same polarity as the toner, drives the toner towards the imaging surface on sheet 60. The toner particles having the same charge as the charge initially placed on the sheet 60 are repelled from the nondischarged areas and attracted towards the discharged or imaged area. Where the photosensitive imaging surface contains defects, and cannot hold all or part of the applied charge, the charge on those defective spots would be approximately the same as the charge in the imaged area after exposure. In repulsion toning, a defective spot in the middle of an imaged area such as a letter would have approximately the same level of charge as the imaged area. Toner deposited on the imaged area would equally be attracted to that portion of the image area which was first fully charged and then discharged as well as to that defective portion of the imaged area which was less than fully charged because of a defect, and is approximately at the same charge level as the charged and exposed image area after exposing. The density of the character would then be unaffected by any defects in the imaging surface on sheet 60. In attraction type toning, however, the background area or nonimaged area is discharged. The image area retains the charge and attracts toner of the opposite polarity. Where a defective spot or area in the web 14 is in an image area, then that spot will have less charge than the rest of the image area retaining the full charge. Any defect in the web which also appears in the image area then would be evident as a spot or area of no charge in an image area of substantially full charge. The toner would not be attracted to the defective spot and where that defective spot was large enough, it would appear as a white spot within a toned image area and affect the quality of the produced image.

Figure 5:
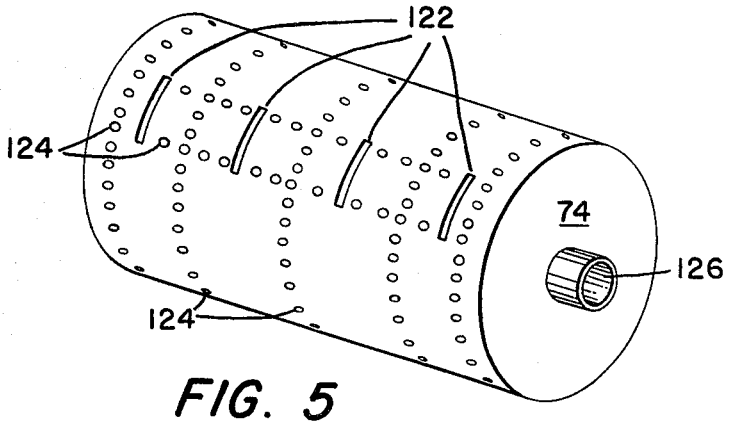
FIG. 5 is a perspective view of the vacuum drum used in the apparatus in FIG. 2.

FIG. 5 illustrates the vacuum drum 74 employed in the apparatus of FIG. 1. As already mentioned, this drum has a 21 inch circumference and accommodates sheets of ZnO-coated paper which are 19 inches long. The leading and trailing edges of a sheet are therefore spaced 2 inches apart on the drum. The drum surface is 12 inches wide to accommodate 11 inch wide sheets.

The sheets of coated paper are brought into intimate physical contact with the drum by vacuum applied through apertures 124 on the drum surface. The drum is hollow and the interior is evacuated through the end opening 126, for example to 15 inches of water, gauge pressure. The apertures are 1/16 inch in diameter and are spaced ½ inch apart near the leading and trailing edges of the paper sheet and 1 inch aperture elsewhere. This arrangement insures that the paper will be held at the constant spacing from the scorotron for uniform charging, at a constant position with respect to the imaging system for proper focus, and at a constant spacing from the toner shoe in the developing device for a uniform electric field.

Figure 6A:
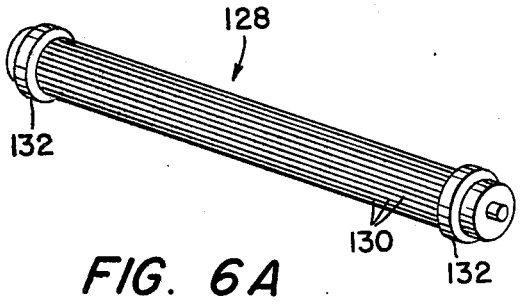
FIGS. 6A and 6B are perspective and cross-sectional views, respectively, of the prewetting drum used in the apparatus of FIG. 2.
Figure 6B:
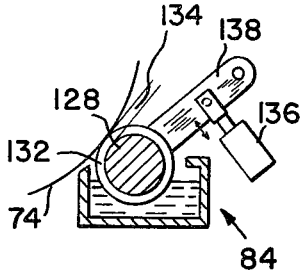

FIGS. 6A and 6B illustrate the prewetting device employed in the apparatus of FIG. 2. FIG. 6A shows the prewetting roller which is typically made of Delrin and provided with closely spaced serrations 130 which carry the liquid dispersant. The prewetting roller has rubber "tires" 132 that contact the surface of the drum when the prewetting device is in operation. As shown in FIG. 6B, these tires define the distance 134 between the prewetting roller 128 and the drum 74. Preferably, this distance is approximately 0.015 inches. As indicates in FIG. 6B, the prewetting roller 128 may be moved toward or away from the drum 74 by a solenoid 136 which acts on a pivot arm 138.

Figure 7A:
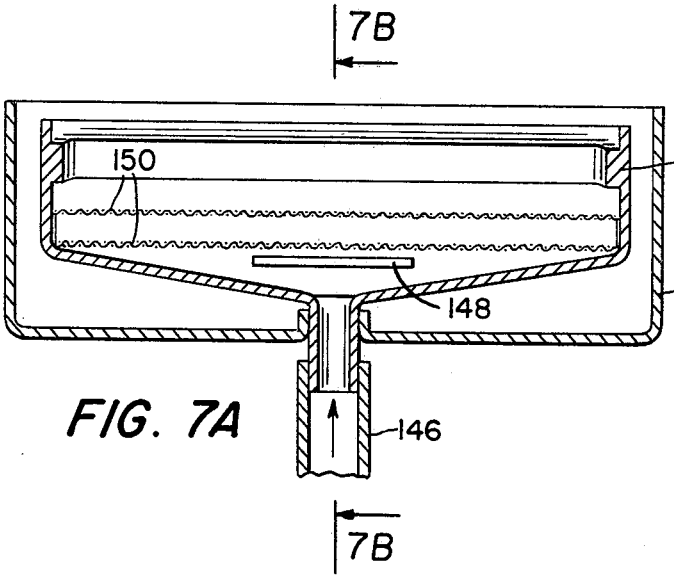
FIGS. 7A, 7B and 7C are longitudinal sectional, cross sectional and top views, respectively, showing the developing device employed in the apparatus of FIG. 2.
Figure 7B:
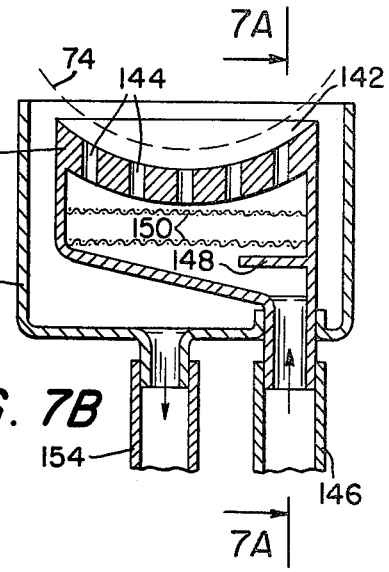
Figure 7C:
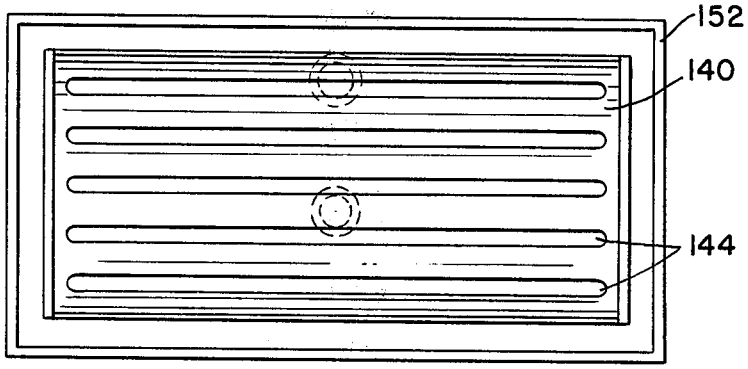

FIGS. 7A, 7B and 7C illustrate the developing device 86 employed in the apparatus of FIG. 2. This device consists of a combination toner shoe and counter electrode 140 having a cylindrical upper surface spaced a prescribed distance 142 from the surface of the drum 74. This distance is preferably about 0.04 inches. The toner shoe has slots 144 for the passage of liquid toner when it is pumped upward from the toner reservoir 118 through a tube 146. A barrier 148 serves to distribute the liquid toner, as do two screens 150. The toner shoe 140 is surrounded by a catchbasin 152 which collects the liquid toner passed upward through the slots 144 and directs it downward through a drain tube 154 to the toner reservoir.

Figure 8A:
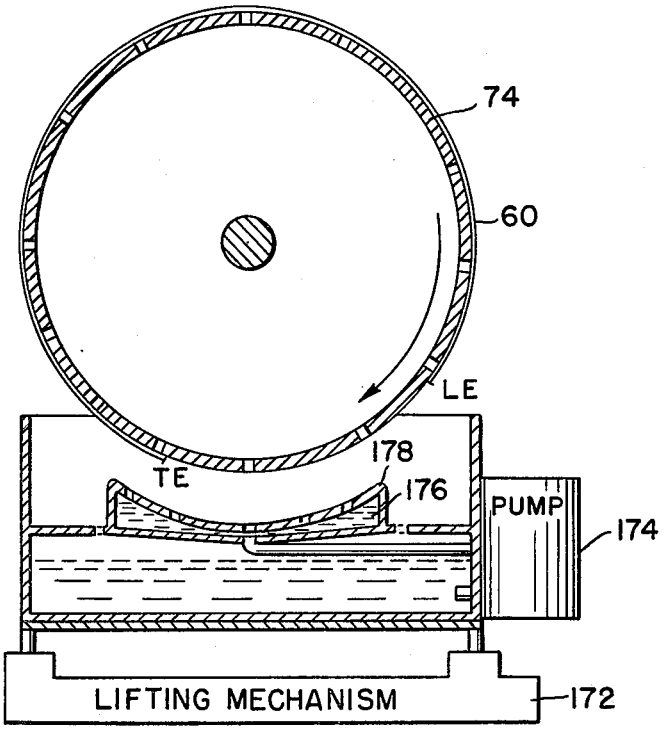
FIGS. 8A and 8B are schematic diagrams showing an alternative form of a developing device.
Figure 8B:
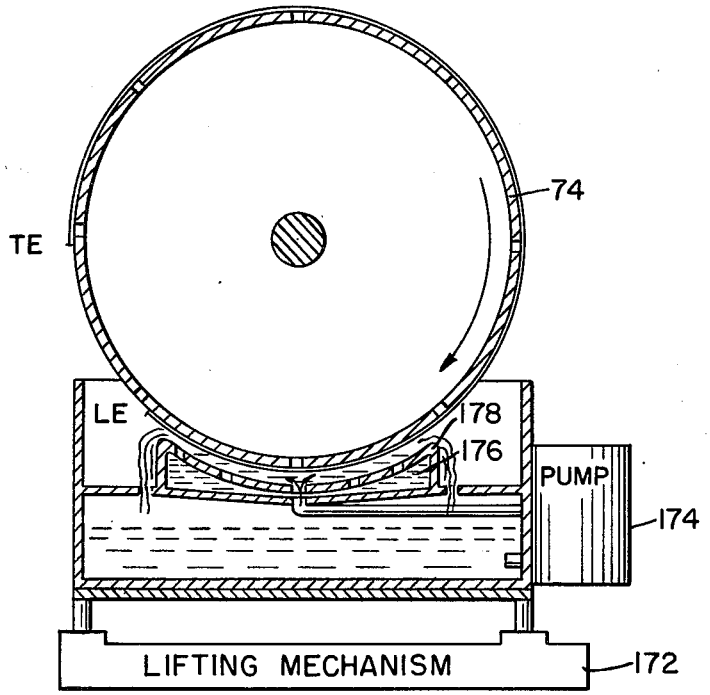

FIGS. 8A and 8B illustrate an alternative embodiment of the developing device having a toner shoe that may be moved toward or away from the vacuum drum 74. This arrangement serves to inhibit the vapors of the liquid toner from reaching the photoconductive surface of the paper sheet 60, thus discharging the surface prior to development. In FIG. 8A the developing device is in the lower position, e.g., during the loading, charging and exposing operations of the apparatus. FIG. 8B shows the developing device raised into the operative position by a lifting mechanism 172 while a pump 174 directs fluid into a chamber 176 below the toner shoe 178. It will be understood that both the toner shoe 140 in the developing device shown in FIG. 7 and the toner shoe 178 in the developing device shown in FIG. 8 function as a counter electrode. This counter electrode is either grounded or connected to a controlled source of voltage.

Figure 9A:
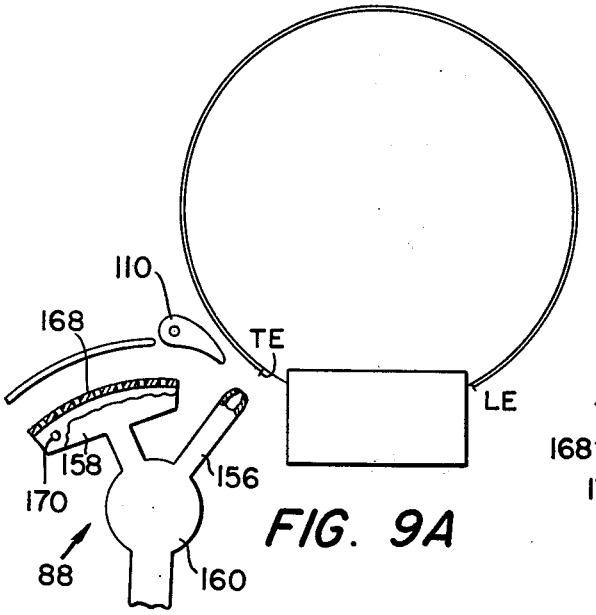
FIGS. 9A and 9B are schematic diagrams showing the outlet portion of the apparatus of FIG. 2.
Figure 9B:
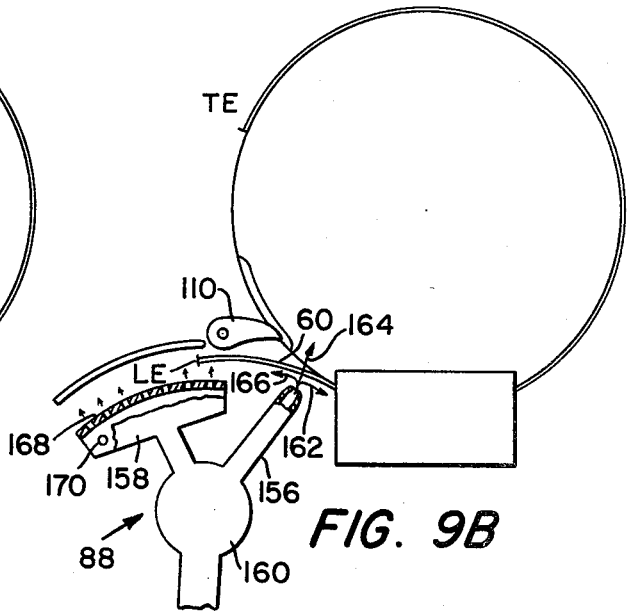

FIGS. 9A and 9B illustrate the drying device 88 and the paper strip fingers 110 employed in the apparatus of FIG. 2. The drying device includes an air jet 156 and an air distributor 158 connected to a source 160 of air under pressure. The air jet 156 directs air against the paper sheet 60 at an angle substantially perpendicular to the surface of the drum. The air divides into three streams: 162, 164 and 166, as shown in FIG. 9B. The stream 162 acts as an "air knife" moving the excess liquid toner carried forward on the surface of the sheet 60 back into the developing device 86. The second stream 164 penetrates the paper and causes evaporation of the liquid dispersant through the back of the paper. The third stream 166 assists in air drying the liquid toner on the surface.

As shown in FIG. 9B, the airstream directed against the sheet 60 supports the sheet 60 after removal from the drum 74 so the imaging surface may be dried and the image fixed without contact with machine parts.

The air distributing device 158 is provided with an apertured partition 168 which directs air against the surface of the paper sheet 60. A resistive wire 170 is provided to heat the air which passes through the apertures toward the left, as seen in FIGS. 9A and 9B. The apertured partition 168 serves to "float" or "levitate" the paper sheet 60 to prevent premature contact between the photoconductive surface and structural parts of the apparatus, to avoid smearing of the toned image.

Figure 10:
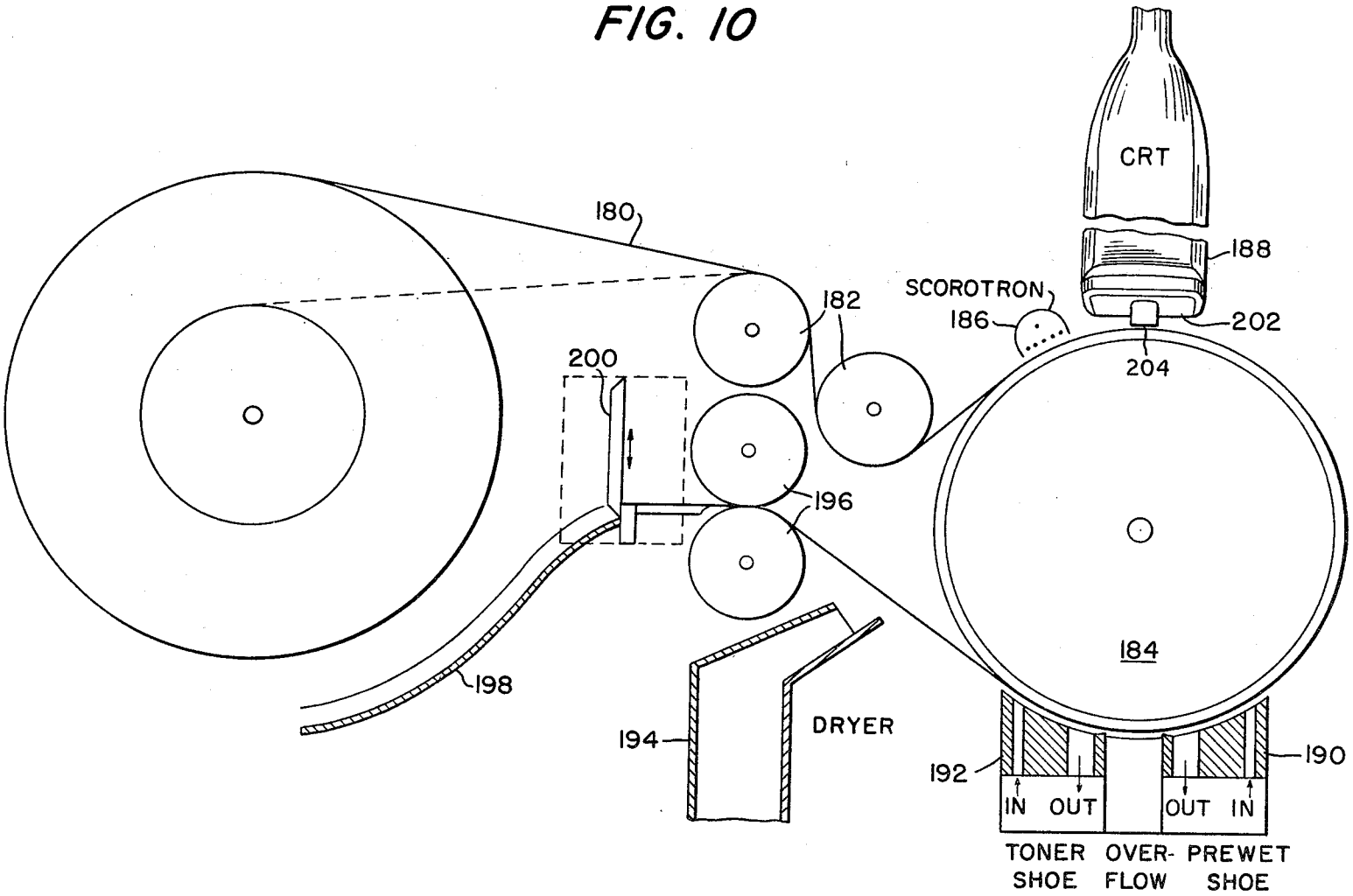
FIG. 10 is a schematic diagram of an alternative embodiment of the electrophotographic apparatus according to the present invention.

FIG. 10 illustrates an alternative embodiment of the electrophotographic apparatus according to the present invention. In this embodiment, a web 180 of ZnO-coated paper is supplied via rollers 182 to a vacuum drum 184. Surrounding the drum are the usual electro-photographic stations: a scorotron 186, an exposing device 188, a prewetting device 190, a developing device 192 and a drying device 194. Pinch rollers 196 draw the web off of the drum 184 and pass it to a chute 198 via a cutting device 200. Because the cutting device is arranged after, in the path of web travel, the various electrophotographic stations, a web of any desired length may be exposed and developed. During operation, therefore, the web 180 may be moved continuously around the drum 184 at a constant speed.

As in the embodiment of FIG. 2, the scorotron 186 deposits a substantially uniform negative charge on the photoconductive surface of the web 180. The exposing device, in this case, is a CRT having a face plate 202 to which are attached a bundle of optical fibers 204. These optical fibers direct the light from the face plate to the photoconductive surface without the necessity of additional optics such as focusing or the like. Preferably, the optical fibers on the face plate have a continuous gradient index of refraction so that they are "self focusing".

The apparatus of FIG. 10, like the apparatus of FIG. 2, may operate with charge attraction toning as well as charge repulsion toning. In this case, the raster scanning device (i.e., the laser scanner 82 in FIG. 2 and the CRT scanner 188 in FIG. 10) would operate in "reverse video" to discharge all areas *except* those areas where characters are to appear. In this case, the toner particles in the liquid toner are positively charged so that they are attracted to the negatively charged character areas. The counter electrode is maintained at a negative charge in order to draw toner particles away from the discharged areas of the photoconductive surface.

As shown in FIGS. 3A to 3F, the paper 60 is loaded, and rotated past the charging means 80, until the trailing edge is past the charging station 80. During the rotation, the paper is then brought forward to the exposing station as shown in FIG. 3C.

Figure 11:
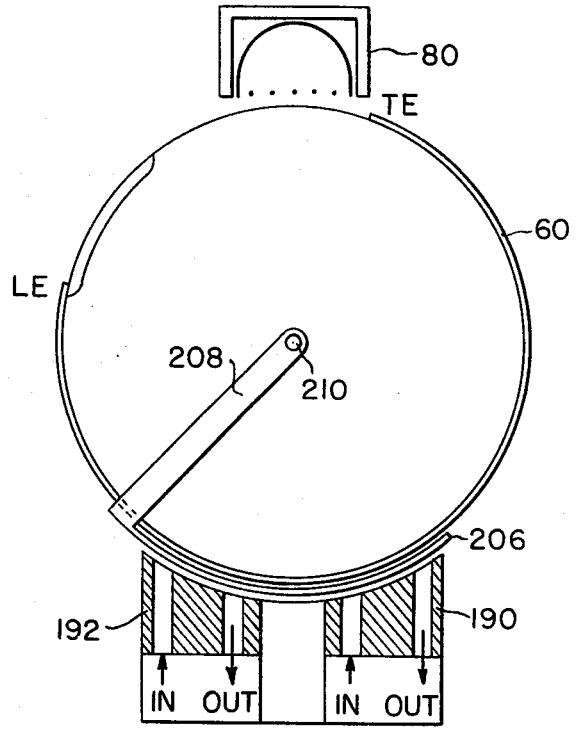
FIG. 11 is a schematic diagram of a portion of an alternative embodiment of the electrophotographic apparatus according to the present invention having a shield operative in connection with the developing and prewetting stations.

Referring now to FIG. 11, where the charged paper 60 is exposed and then rotated past the toning station, the vapors from the liquid dispersants in the prewetting device 190 and the developing device 192 may discharge the charged surface of the paper 60.

To avoid discharge of the paper by contact with the vapors, a shield 206 is provided opposite the developing station 192 and prewetting station 190, shielding the paper from the vapors, after charging by corotron 80 and before the paper surface is toned.

As shown in FIG. 11, the shield 206 is shown opposite the developing and prewetting stations 190 and 192 and placed between those stations and the charged paper. The shield 206 is supported by arm 208 and is mounted for pivotal movement on pivotal support 210.

Figure 3F:
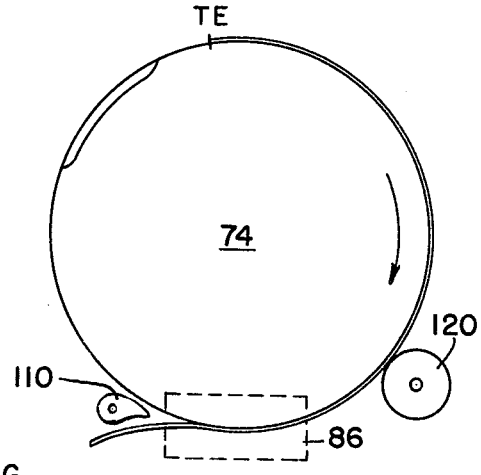

During the prewet and developing operation, as shown in FIGS. 3E and 3F, the shield may be suitably rotated by a means, (not shown) to an angular position such that the shield is no longer between the prewetting and developing stations, and the fluid in these stations may be applied to the paper surface.

It should be understood that the shield may be used solely with the developing station or solely with the prewetting station or two shields may be employed, one to prevent vapors from the developing station 192 reaching the paper 60 and a second shield to prevent vapors from the prewetting station 190 reaching the paper 60.

In this case, separate means (not shown) would be used for separately moving the shield for the developing station and the shield for the prewetting station.

Figure 12:
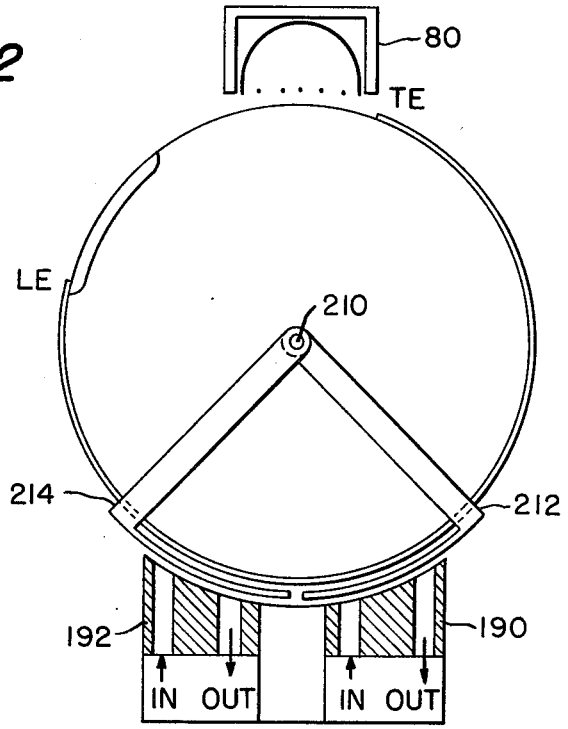
FIG. 12 is a schematic diagram of a portion of another alternative embodiment of the electrophotographic apparatus according to the present invention having separate movable shields associated with the prewetting station and the developing station.

In FIG. 12, two separate shields are used, shield 212 for the prewet station 190 and shield 214 for the developing station 192. The shield can be separately pivoted about pivot support 210 and may be controlled for movement by any suitable means.

During the prewet and developing operation as shown in FIG. 3E and 3F, the shield 212 and 214 may be rotated by a means not shown to an angular position such that the shields are no longer between these stations and the paper 60.

While there have been described what are believed to be the preferred embodiments of the present invention, those skilled in the art will recognize that various changes and modifications may be made thereto without departing from the spirit of the invention, and it is intended to claim all such embodiments as fall within the true scope thereof.

We claim:

1. Apparatus for electrophotographically producing a graphic arts quality image for further reproduction including a support and transport means, means for mounting an image receiving medium on said support means, said medium being a substrate having a photoconductive surface, means for charging the photoconductive surface, means for exposing the photoconductive layer to produce a latent image, means for developing the latent image and means for removing the substrate substantially without contacting the photoconductive surface, and wherein said photoconductive substrate is mounted with said photoconductive surface facing away from the support means, said charging means being disposed adjacent to said support means for applying a substantially uniform charge to the photoconductive surface, said exposing means directing radiation to the photoconductive surface to form a latent image, development means adjacent the said support means for applying toner to the latent image on the said photoconductive surface and including means for moving the toner into contact with the photoconductive surface, and prewetting means disposed adjacent said support means for depositing a second liquid dispersant onto said photoconductive surface after exposing and charging but before developing, to provide a barrier between said toner particles and said photoconductive surface to hold said toner away from said surface until directed, by the electrostatic forces between said toner particles and said latent image, to said surface, to develop said latent image, and means disposed adjacent to said support means for removing excess liquid toner on the photoconductive surface and drying said surface as said surfaces emerges from said development means, and whereby said substrate is mounted and transported past said charging, exposing, prewet, developing, drying means, and removing means, without physical contact to said surface, to produce said graphic arts quality image.

2. The apparatus defined in claim 1, wherein said image receiving medium includes a paper substrate coated with a photoconductive layer.

3. The apparatus defined in claim 2, wherein said photoconductive layer comprises zinc oxide and a resin binder.

4. The apparatus defined in claim 3, wherein said photoconductive layer further comprises at least one dye for absorbing radiation at that part of the radiation spectrum which is directed onto said photoconductive surface by said exposing means.

5. The apparatus defined in claim 1, wherein said image receiving medium is supplied in a web roll and wherein said apparatus further comprises means for rotatably holding said web roll, means for delivering the web from said roll to said transporting means, and means, arranged between said holding and said transporting means, for cutting said web into sheets to be supported by said transporting means.

6. The apparatus defined in claim 1, wherein said image receiving medium is supplied in a web roll and wherein said apparatus further comprises means for rotatably holding said web roll, means for delivering the web from said roll to said transporting means, and means, arranged between said transporting means and the outlet of said apparatus, for cutting said web into sheets after an image thereon has been developed.

7. The apparatus defined in claim 1, wherein said transporting means includes means for removably holding said image receiving medium, said holding means comprising a movable carrier surface for supporting said image receiving medium, and means for applying a vacuum to said carrier surface to draw said image receiving medium into intimate physical contact therewith.

8. The apparatus defined in claim 7, wherein said transporting means includes a rotatable drum, the external surface of said drum forming said carrier surface, said drum having an interior chamber and a plurality of openings extending outwardly from said interior chamber to said exterior surface, said transporting means further including means for evacuating said interior chamber.

9. The apparatus defined in claim 1, wherein said charging means deposits a negative charge on said photoconductive surface.

10. The apparatus defined in claim 1, wherein said charging means includes a screen controlled corona charging device having at least one high voltage emitter arranged to discharge onto said photoconductive surface, and a plurality of suitably charged grid wires, arranged between said emitter and said photoconductive surface, for controlling the movement of charge from said emitter to said photoconductive surface.

11. The apparatus defined in claim 1, wherein the charge deposited on the photoconductive surface is in the range of 250–300 apparent surface volts.

12. The apparatus defined in claim 1, wherein said exposing means includes a light source and a movable character carrier arranged in the optical path between said light source and said photoconductive surface, said character carrier having recorded thereon a photographic reproduction of each character of at least one font.

13. The apparatus defined in claim 12, wherein the photographic reproduction provides a negative image of each character, whereby light is permitted to pass through said character carrier and impinge on said photoconductive surface at the places where character images are to appear.

14. The apparatus defined in claim 12, wherein said light source is a xenon flashlamp and wherein said character carrier is a photographic font strip arranged on a drum for continuous rotation.

15. The apparatus recited in claim 1, wherein said exposing means includes a scanning device having means for generating a scanning beam and means for moving said scanning beam across said photoconductive surface in a scan line, said means for generating said scanning beam including means for switching said scanning beam on and off, said scan line thereby forming a raster line on said photoconductive surface.

16. The apparatus recited in claim 15, wherein said scan line extends horizontally parallel to lines of type which are imaged on said photoconductive surface.

17. The apparatus defined in claim 15, wherein said scanning device includes a cathode ray tube having a flourescent faceplate, and includes a plurality of optical fibers for transmitting light from said faceplate to said photoconductive surface.

18. The apparatus defined in claim 15, wherein said scanning beam generating means includes a laser; wherein said scanning beam moving means includes a mirror and controllable drive means for tilting said mirror back and forth about an axis; and wherein said scanning beam switching means includes a beam modulator.

19. The apparatus defined in claim 1, said prewetting means, disposed adjacent to said transporting means, for depositing a second liquid dispersant onto said photoconductive surface after charging and exposing, but before developing said surface.

20. The apparatus defined in claim 19, wherein said second liquid dispersant in said prewetting means is the same as said first liquid dispersant in said developing means.

21. The apparatus defined in claim 20, wherein said liquid dispersant in said prewetting means and said developing means is oderless mineral spirits.

22. The apparatus defined in claim 19, wherein said prewetting means includes means for inhibiting the vapor of said second liquid dispersant from reaching said photoconductive surface, thereby discharging said surface, when said second liquid dispersant is not being deposited thereon.

23. The apparatus defined in claim 22, wherein said vapor inhibiting means includes means for moving said prewetting means away from said photoconductive surface when not in use.

24. The apparatus defined in claim 22, wherein said vapor inhibiting means includes a vapor shield, and means for inserting said vapor shield between said second liquid dispersant in said prewetting means and said photoconductive surface when said prewetting means is not in use.

25. The apparatus defined in claim 1, wherein said developing means includes means for inhibiting the vapors of said first liquid dispersant from reaching said photoconductive surface, thereby discharging said surface when said liquid toner is not applied thereto.

26. The apparatus defined in claim 25, wherein said vapor inhibiting means includes means for moving said developing means away from said photoconductive surface when not in use.

27. The apparatus defined in claim 25, wherein said vapor inhibiting means includes a vapor shield, and means for inserting said vapor shield between said first liquid dispersant in said developing means and said photoconductive surface when said developing means is not in use.

28. The apparatus defined in claim 1, wherein said developing means further comprises a counter electrode, disposed adjacent to said transporting means, for electrostatically driving said toner particles in said liquid toner towards said photoconductive surface.

29. The apparatus defined in claim 28, wherein said counter electrode is grounded.

30. The apparatus defined in claim 28, wherein said developing means further comprises biasing means for maintaining a bias on said counter electrode.

31. The apparatus defined in claim 30, wherein said charging means maintains a charge in the range of 50–150 volts on said counter electrode.

32. The apparatus defined in claim 28, wherein said developing means is disposed below said transporting means with said liquid toner reservoir formed by said counter electrode.

33. The apparatus defined in claim 32, wherein said liquid toner moving means includes a pump for lifting said liquid toner on demand from said reservoir to said photoconductive surface.

34. The apparatus defined in claim 30, wherein said biasing means maintains a bias of approximately negative 20 volts on said counter electrode.

35. The apparatus defined in claim 1, wherein said excess toner removing means includes an air knife for directing a stream of air against said photoconducting surface, thereby to move excess liquid toner carried forward on said surface back into said developing means.

36. The apparatus defined in claim 35, wherein said stream of air is supplied to said photoconductive surface in a direction substantially perpendicular to said surface.

37. The apparatus defined in claim 1, said removing means removing said image receiving medium from said transporting means after it passes said developing means.

38. The apparatus defined in claim 37, wherein said removing means includes at least one movable finger arranged to be placed into the path of the leading edge of said image receiving medium, thereby to intercept said leading edge after it passes said developing means.

39. The apparatus defined in claim 1, said drying means drying said image receiving medium after it passes said developing means.

40. The apparatus defined in claim 39, wherein said drying means includes means for directing a stream of air against said photoconductive surface after it emerges from said developing means.

41. The apparatus defined in claim 40, wherein said drying means further includes means for heating said air which is directed against said photoconductive surface.

42. The apparatus defined in claim 40, wherein said air stream directing means includes an apertured partition, arranged beneath said image receiving medium as it emerges from said developing means, and means to supply air under pressure to the lower side of said apertured partition, thereby to levitate said image receiving medium until the toner is sufficiently dry to prevent smearing on contact.

43. The apparatus of claim 1, wherein said means for removing excess toner and drying said surface includes an air knife directing a stream of air to said substrate to support said substrate after said substrate is removed from said support and transport means.

44. The apparatus of claim 43, wherein said airstream divides into a plurality of streams at said substrate, at least one of said streams moving excess liquid toner back into said development means and a second of said streams supporting said substrate to prevent contact of said image surface with machine parts when said surface is adjacent the drying means.

45. The apparatus of claim 44, wherein at least one of said plurality of streams penetrate the substrate causing evaporation of the liquid dispersant.

46. The apparatus of claim 43, wherein said air stream is directed substantially perpendicular to said substrate.

47. The apparatus of claim 1, wherein said charge applied by said charging means is less than saturation charge, and wherein said toner particles are charged with the same sign as said photoconductive surface and are repelled from said photoconductive surface except at the discharged areas on the photoconductive surface.

48. The apparatus of claim 47, wherein said development means includes an electrode biased to electrostatically drive the toner particles from the liquid toner towards the photoconductive surface.

49. Electrophotographic apparatus for producing a high quality toned, first generation image, said apparatus comprising, in combination:

(a) means for supporting and transporting an image receiving medium having a flexible substrate and a photoconductive surface, said photoconductive surface facing away from said transporting means;

(b) charging means, disposed adjacent to said transporting means, for supplying a substantially uniform charge on said photoconductive surface, said charge being substantially less than saturation charge of said surface;

(c) exposing means for directing radiation to said photoconductive surface after charging at the areas where toned images are to appear, thereby to discharge said surface in said areas; and (d) developing means, disposed adjacent to said transporting means, for applying liquid toner to the discharge areas on said photoconductive surface after exposing, said developing means including:

(1) a reservoir of liquid toner comprising toner particles suspended in a first liquid dispersant;

(2) means for moving said liquid toner in said reservoir into contact with said photoconductive surface;

and wherein said toner particles are charged with the same sign as said photoconductive surface and are thereby repelled from said photoconductive surface except at said discharged areas thereof, said imaging receiving medium includes a paper substrate coated with a photoconductive layer, said photoconductive layer comprising zinc oxide and a resin binder and wherein said photoconductive layer further comprises at least one dye for absorbing radiation at that part of the radiation spectrum which is directed onto said photoconductive surface by said exposing means.

50. Electrophotographic apparatus for producing high quality, toned, first generation images, said apparatus comprising in combination;

(a) means for supporting and transporting an image receiving medium having a flexible substrate and a photoconductive surface, said photoconductive surface facing away from said transporting means;

(b) charging means, disposed adjacent to said transporting means, for supplying a substantially uniform charge on said photoconductive surface, said charge being substantially less than the saturation charge of said surface;

(c) exposing means for directing radiation to said photoconductive surface after charging at the areas where toned images are to appear, thereby to discharge said surface in said areas; and (d) developing means, disposed adjacent to said transporting means, for applying liquid toner to the discharge areas on said photoconductive surface after exposing, said developing means including:
(1) a reservoir of liquid toner comprising toner particles suspended in a first liquid dispersant;
(2) means for moving said liquid toner in said reservoir into contact with said photoconductive surface;

wherein said toner particles are charged with the same sign as said photoconductive surface and are thereby repelled from said photoconductive surface except at said discharged areas thereof, and wherein said exposing means includes a light source and a movable character carrier arranged in the optical path between said light source and said photoconductive surface, said character carrier having recorded thereon a photographic reproduction of each character of at least one font, the photographic reproduction provides a negative image of each character, whereby light is permitted to pass through said character carrier and impinge on said photoconductive surface at the places where character images are to appear, wherein said light source is a xenon flashlamp and wherein said character carrier is a photographic font strip arranged on a drum for continuous rotation.

51. Electrophotographic apparatus for producing high quality, toned, first generation images, said apparatus comprising, in combination;
(a) means for supporting and transporting an image receiving medium having a flexible substrate and a photoconductive surface, said photoconductive surface facing away from said transporting means;
(b) charging means, disposed adjacent to said transporting means, for supplying a substantially uniform charge on said photoconductive surface, said charge being substantially less than the saturation charge of said surface;
(c) exposing means for directing radiation to said photocoductive surface after charging at the areas where toned images are to appear, thereby to discharge said surface in said areas; and
(d) developing means, disposed adjacent to said transporting means, for applying liquid toner to the discharge areas on said photoconductive surface after exposing, said developing means including:
(1) a reservoir of liquid toner comprising toner particles suspended in a first liquid dispersant;
(2) means for moving said liquid toner in said reservoir into contact with said photoconductive surface;

wherein said toner particles are charged with the same sign as said photoconductive surface and are thereby repelled from said photoconductive surface except at said discharged areas thereof, and comprising prewetting means, disposed adjacent to said transporting means, for depositing a second liquid dispersant onto said photoconductive surface after charging and exposing, but before developing said surface, said prewetting means includes means for inhibiting the vapor of said second liquid dispersant from reaching said photoconductive surface, thereby discharging said surface, when said second liquid dispersant is not being deposited thereon.

52. The apparatus appearing in claim 51, wherein said vapor inhibiting means includes means for moving said prewetting means away from said photoconductive surface when not in use.

53. The apparatus defined in claim 51, wherein said vapor inhibiting means includes a vapor shield, and means for inserting said vapor shield between said second liquid dispersant in said prewetting means and said photoconductive surface when said prewetting means is not in use.

54. Electrophotographic apparatus for producing high quality, toned, first generation images, said apparatus comprising, in combination:
(a) means for supporting and transporting an image receiving medium having a flexible substrate and a photoconductive surface, said photoconductive surface facing away from said transporting means;
(b) charging means, disposed adjacent to said transporting means, for supplying a substantially uniform charge on said photoconductive surface, said charge being substantially less than the saturation charge of said surface;
(c) exposing means for directing radiation to said photoconductive surface after charging at the areas where toned images are to appear, thereby to discharge said surface in said areas; and
(d) developing means, disposed adjacent to said transporting means, for applying liquid toner to the discharge areas on said photoconductive surface after exposing, said developing means including:
(1) a reservoir of liquid toner comprising toner particles suspended in a first liquid dispersant;
(2) means for moving said liquid toner in said reservoir into contact with said photoconductive surface;

wherein said toner particles are charged with the same sign as said photoconductive surface and are thereby repelled from said photoconductive surface except at said discharged areas thereof, and wherein said developing means includes means for inhibiting the vapors of said first liquid dispersant from reaching said photoconductive surface, thereby discharging said surface when said liquid toner is not applied thereto, said vapor inhibiting means includes means for moving said developing means away from said photoconductive surface when not in use, said vapor inhibiting means includes a vapor shield, and means for inserting said vapor shield between said first liquid dispersant in said developing means and said photoconductive surface when said developing means is not in use.

55. Electrophotographic apparatus for producing high quality, toned, first generation images, said apparatus comprising, in combination:
(a) means for supporting and transporting an image receiving medium having a flexible substrate and a photoconductive surface, said photoconductive surface facing away from said transporting means;
(b) charging means, disposed adjacent to aid transporting means, for supplying a substantially uniform charge on said photoconductive surface, said charge being substantially less than the saturation charge of said surface;
(c) exposing means for directing radiation to said photoconductive surface after charging at the areas where toned images are to appear, thereby to discharge said surface in said areas; and
(d) developing means, disposed adjacent to said transporting means, for applying liquid toner to the discharge areas on said photoconductive surface after exposing, said developing means including:

(1) a reservoir of liquid toner comprising toner particles suspended in a first liquid dispersant:

(2) means for moving said liquid toner in said reservoir into contact with said photoconductive surface;

wherein said toner particles are charged with the same sign as said photoconductive surface and are thereby repelled from said photoconductive surface except at said discharged areas thereof, and comprising means for removing said image receiving medium from said transporting means after it passes said developing means, wherein said removing means includes at least one movable finger arranged to be placed into the path of the leading edge of said image receiving medium, thereby to intercept said leading edge after it passes said developing means.

56. Electrophotographic apparatus for producing high quality, toned, first generation images, said apparatus comprising, in combination:

(a) means for supporting and transporting an image receiving medium having a flexible substrate and a photoconductive surface, said photoconductive surface facing away from said transporting means;

(b) charging means, disposed adjacent to said transporting means, for applying a substantially uniform charge on said photoconductive surface, said charge being substantially less than the saturation charge of said surface;

(c) exposing means for directing radiation to said photoconductive surface after charging at the areas where no images are to appear, thereby to discharge said surface in said areas;

(d) developing means, disposed adjacent to said transporting means, for applying liquid toner to the charged areas on said photoconductive surface after exposing said developing means including:

(1) a reservoir of liquid toner comprising toner particles suspended in a first liquid dispersant;

(2) means for moving said liquid toner in said reservoir into contact with said photoconductive surface;

wherein said toner particles are charged with the opposite sign as said photoconductive surface and are thereby attracted to said photoconductive surface at said charged areas thereof, said image receiving medium includes a paper substrate coated with a photoconductive layer, said photoconductive layer comprising zinc oxide, and wherein said photoconductive layer further comprises at least one dye for absorbing radiation at that part of the radiation spectrum which is directed onto said photoconductive surface by said exposing means.

57. Electrophotographic apparatus for producing high quality, toned, first generation images, said apparatus comprising, in combination:

(a) means for supporting and transporting an image receiving medium having a flexible substrate and a photoconductive surface, said photoconductive surface facing away from said transporting means;

(b) charging means, disposed adjacent to said transporting means, for applying a substantially uniform charge on said photoconductive surface, said charge being substantially less than the saturation charge of said surface;

(c) exposing means for directing radiation to said photoconductive surface after charging at the areas where no images are to appear, thereby to discharge said surface in said areas; and (d) developing means, disposed adjacent to said transporting means, for applying liquid toner to the charged areas on said photoconductive surface after exposing, said developing means including:

(1) a reservoir of liquid toner comprising toner particles suspended in a first liquid dispersant;

(2) means for moving said liquid toner in said reservoir into contact with said photoconductive surface;

wherein said toner particles are charged with the opposite sign as said photoconductive surface and are thereby attracted to said photoconductive surface at said charged areas thereof, prewetting means, disposed adjacent to said transporting means, for depositing a second liquid dispersant onto said photoconductive surface after charging and exposing, but before developing said surface, said prewetting means includes means for inhibiting the vapor of said second liquid dispersant from reaching said photoconductive surface, thereby discharging said surface, when said second liquid dispersant is not being deposited thereon.

58. The apparatus defined in claim 57, wherein said second liquid dispersant in said prewetting means is the same as said first liquid dispersant in said developing means.

59. The apparatus defined in claim 58, wherein said vapor inhibiting means includes means for moving said prewetting means away from said photoconductive surface when not in use.

60. The apparatus defined in claim 59, wherein said vapor inhibiting means includes a vapor shield, and means for inserting said vapor shield between said second liquid dispersant in said prewetting means and said photoconductive surface when said prewetting means is not in use.

61. Electrophotographic apparatus for producing high quality, toned, first generation images, said apparatus comprising, in combination:

(a) means for supporting and transporting an image receiving medium having a flexible substrate and a photoconductive surface, said photoconductive surface facing away from said transporting means;

(b) charging means, disposed adjacent to said transporting means, for applying a substantially uniform charge on said photoconductive surface, said charge being substantially less than the saturation charge of said surface;

(c) exposing means for directing radiation to said photoconductive surface after charging at the areas where no images are to appear, thereby to discharge said surface in said areas;

(d) developing means, disposed adjacent to said transporting means, for applying liquid toner to the charged areas on said photoconductive surface after exposing, said developing means including:

(1) a reservoir of liquid toner comprising toner particles suspended in a first liquid dispersant;

(2) means for moving said liquid toner in said reservoir into contact with said photoconductive surface;

wherein said toner particles are charged with the opposite sign as said photoconductive surface and are thereby attracted to said photoconductive surface at said charged areas thereof, said developing means includes means for inhibiting the vapors of said first liquid dispersant from reaching said photoconductive surface, thereby discharging said surface when said liquid toner is not applied thereto, said vapor inhibiting means includes a vapor shield, and means for inserting said vapor shield between said first liquid dispersant in said developing means and said photoconductive surface when said developing means is not in use.

62. Electrophotographic apparatus for producing high quality, toned, first generation images, said apparatus comprising, in combination:

(a) means for supporting and transporting an image receiving medium having a flexible substrate and a photoconductive surface, said photoconductive surface facing away from said transporting means;

(b) charging means, disposed adjacent to said transporting means, for applying a substantially uniform charge on said photoconductive surface, said charge being substantially less than the saturation charge of said surface;

(c) exposing means for directing radiation to said photoconductive surface after charging at the areas where no images are to appear, thereby to discharge said surface in said areas; and (d) developing means, disposed adjacent to said transporting means, for applying liquid toner of the charged areas on said photoconductive surface after exposing, said developing means including:

(1) a reservoir of liquid toner comprising toner particles suspended in a first liquid dispersant;

(2) means for moving said liquid toner in said reservoir into contact with said photoconductive surface;

wherein said toner particles are charged with the opposite sign as said photoconductive surface and are thereby attracted to said photoconductive surface at said charged areas thereof, means for removing said image receiving medium from said transporting means after it passes said developing means, said removing means includes at least one movable finger arranged to be placed into the path of the leading edge of said image receiving medium, thereby to intercept said leading edge after it passes said developing means.

* * * * *